United States Patent [19]

Irwin

[11] Patent Number: 5,004,119

[45] Date of Patent: Apr. 2, 1991

[54] DRAIN SEALING APPARATUS

[75] Inventor: Lawrence F. Irwin, Sylmar, Calif.

[73] Assignee: Augerscope, Inc., Sylmar, Calif.

[21] Appl. No.: 386,633

[22] Filed: Jul. 31, 1989

[51] Int. Cl.[5] ..... B65D 45/00

[52] U.S. Cl. ..... 220/247; 220/251

[58] Field of Search ..... 220/238, 243, 245, 246, 220/247, 248, 249, 250, 251

[56] References Cited

U.S. PATENT DOCUMENTS

| | | | |
|---|---|---|---|
| 1,676,395 | 7/1928 | Korner | 220/251 X |
| 2,329,037 | 9/1943 | Eisenberg | 220/245 |
| 2,348,273 | 5/1944 | Yaggy | 220/250 X |
| 3,394,834 | 7/1968 | Cigliano | 220/251 |
| 3,874,550 | 4/1975 | Gordon | 220/251 X |

*Primary Examiner*—Stephen Marcus
*Assistant Examiner*—Nova Stucker
*Attorney, Agent, or Firm*—James E. Brunton

[57] ABSTRACT

An apparatus for temporarily sealing a vent or overflow aperture provided in the upper portion of a fixture such as a wash basin, sink, bathtub or bidet so that a pneumatic or hydraulic type sewer cleanout device can be used to clear a blockage located in a sewer line downstream of the fixture by generating fluid pressure within the sewer line intermediate the blockage and the main water drain of the fixture.

10 Claims, 1 Drawing Sheet

DRAIN SEALING APPARATUS

BACKGROUND OF THE INVENTION

1. Field of The Invention

The present invention relates generally to devices for sealably closing vent apertures provided in the walls of various types of fixtures. More particularly, the invention concerns a device for use in temporarily sealing vents or overflow drains of the character typically provided in the upper wall portions of fixtures such as wash basins, sinks, bathtubs, and bidets.

2. Discussion of The Invention

In recent years several hydraulic and pneumatic devices have been developed for clearing blockages in drain lines by forcing fluids under pressure through the water outlet drain of the fixture. Such devices may force water or other liquids under pressure through the drain outlet, or they may be of the pneumatic impact or "air hammer" type which forces compressed air or other gases through the drain and into the sewer line.

Prior art cleanout devices of the aforementioned character lose their effectiveness when used with fixtures having a vent or overflow drain apertures. Such apertures are usually provided in the upper portions of the fixture and function to drain water from the fixture into the drain line connected to the drain outlet if the fixture is accidentally over filled. The overflow drain apertures are, of necessity, in communication with the sewer drain line which, in turn, is in communication with the fixture drain, or outlet. When a fluid pressure type cleanout device is used to clear a blockage in the drain line, the overflow apertures must be sealed. Otherwise the fluid forced through the fixture drain under pressure can flow outwardly through the overflow drain apertures before sufficient fluid pressure can be exerted against the blockage to open the line to normal water drainage from the fixture.

In many instances, the overflow apertures provided in a given fixture are in communication with an internal fluid passageway defined between inner and outer, spaced apart walls. The inner wall of the fixture typically defines the water reservoir while the outer wall defines the exterior surfaces of the fixture. Since, with this type of construction, the overflow apertures are accessible only from the inside of the fixture, effective sealing of the apertures can be difficult. For this reason, most types of prior art overflow drain seals involve the use of tapered plugs which can be inserted into the overflow apertures from the interior of the bowl of the fixture. However, such plugs are typically ineffective in sealing the overflow apertures against fluid pressure which is built up interiorly of the walls of the fixture by fluid pressure type cleanout tools. In instances of stubborn blockage of the sewer drain line, the cleanout tool will generate sufficient pressure within the internal passageway of the fixture to blowout the sealing plugs before clearing the blockage in the line. When this occurs the plugs, along with the backed up fluid, can be ejected with a force that can cause serious personal injury and cause cost property damage.

The purpose of the present invention is to provide a simple, easy to use apparatus which can be employed to effectively seal overflow drain apertures provided in a given fixture against even substantial fluid pressures which may be generated against the sealing member of the apparatus by a pressure type sewer line cleanout tool. Because of the unique design of the apparatus of the invention, it can effectively be used with fixtures of widely varying designs and configurations.

SUMMARY OF THE INVENTION

It is an object of the present invention to provide an apparatus for effectively sealing vent and overflow drain apertures of the character provided in the inner wall of a dual wall bathtub, wash basin, sink or bidet, against fluid pressures generated in the overflow drain passageways of the fixture.

Another object of the invention is to provide an apparatus of the aforementioned character which can be used in conjunction with fluid pressure type sewer line cleanout tools to enable the tool to be effectively used to clear stoppages formed in the sewer drain line downstream from the main water drain of the fixture.

Another object of the invention is to provide an apparatus as described in the preceding paragraphs which can be used with fixtures of widely varying shape and drain design.

Still another object of the invention is to provide an overflow drain sealing device which can be operated by unskilled persons without the need for any type of auxiliary tools.

A further object of the invention is to provide an apparatus of the character described which is compact, lightweight and highly reliable in use.

Still another object of the invention is to provide a vent sealing apparatus which is constructed from a minimum number of parts, and can be inexpensively manufactured.

DESCRIPTION OF THE INVENTION

Figure 1:
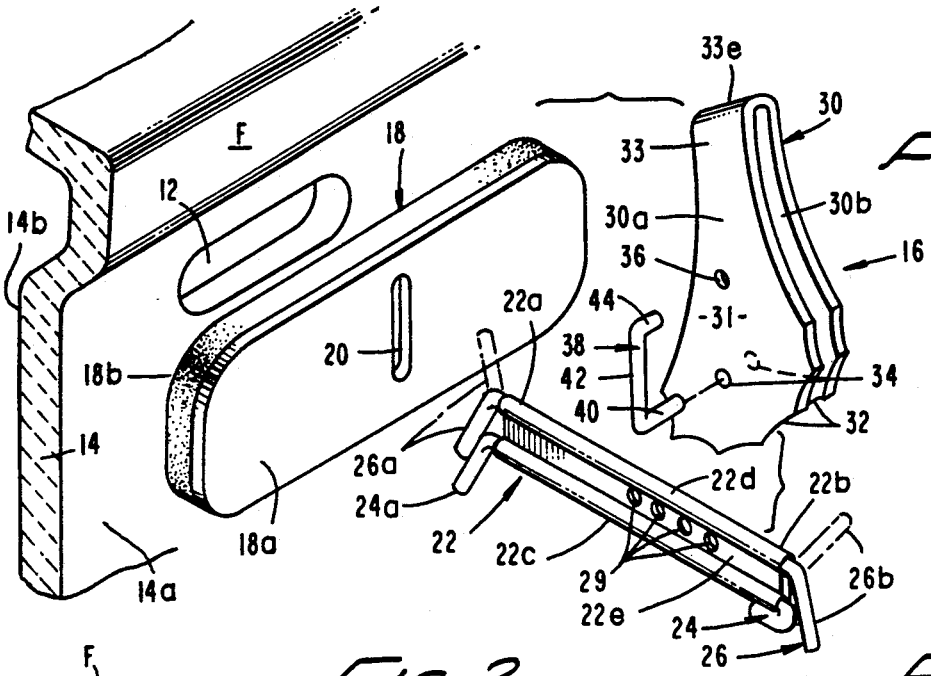
FIG. 1 is a generally perspective view of the overflow drain sealing apparatus of the present invention.
Figure 2:
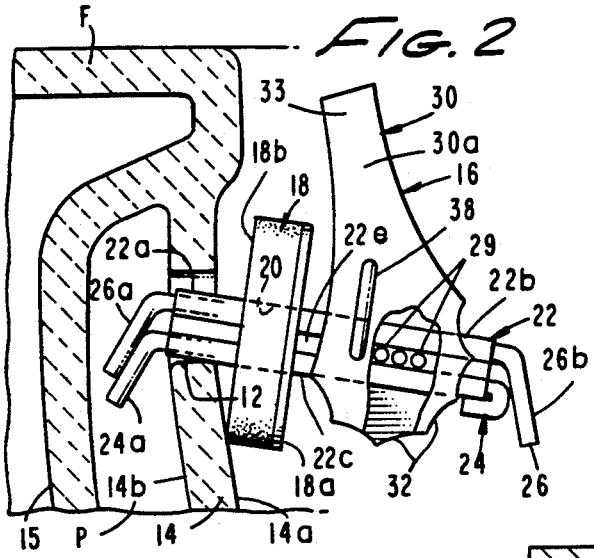
FIG. 2 is a side view of the apparatus partly broken away to show internal construction and illustrating the manner of insertion of the device into the overflow drain of a standard wash basin.

Referring to the drawings and particularly to FIGS. 1 and 2, the apparatus for sealably closing an aperture 12 provided in a wall 14 having first and second surfaces **14*a* and 14*b*, is generally designated by the numeral 16. The apparatus of the embodiment of the invention shown in the drawings comprises wall engaging means for sealably engaging the first surface 14*a* of the wall 14 at a location surrounding the aperture and actuating means operably associated with the wall engaging means for moving a sealing member 18 of the wall engaging means into sealable engagement with the first, or outer surface 14*a* of the wall. As best seen by referring to FIG. 1, sealing member 18 includes a first rigid surface 18*a* and a second, or rear, yieldably deformable surface 18*b* for engaging the front surface 14*a* of wall 14. An aperture 20 is provided proximate the center of sealing member 18**, the purpose of which will presently be described.

In the instant form of the invention, the actuating means comprises a cam support member 22; an elongated, first locking element 24 connected to the cam support member 22; a second, elongated locking element 26 rotatably connected to member 22 and cam means rotatably connected to support member 22 for engagement with sealing member 18 to urge the member into pressural engagement with the first or outer surface 14*a* of wall 14. Cam support member 22 has first and second ends 22*a* and 22*b*, first and second margin portions 22*c* and 22*d*, and a web portion 22*e* disposed intermediate margin portions 22*c* and 22*d*. Web portion 22*e* is provided with a plurality of longitudinally spaced apertures 29.

Figure 5:
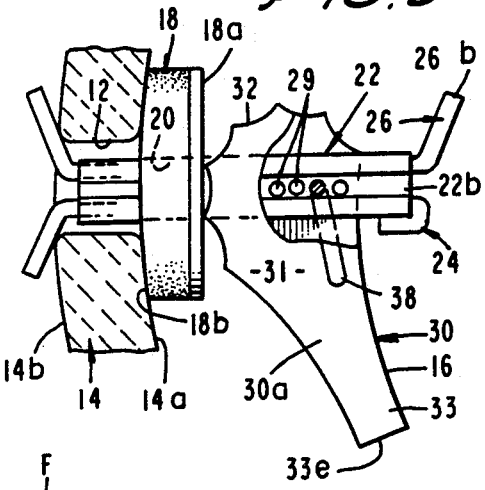
FIG. 5 is a cross sectional view similar to FIG. 3, but illustrating the device being used to seal the overflow drain of a wash basin having a greater wall thickness than that shown in FIG. 3.
Figure 3:
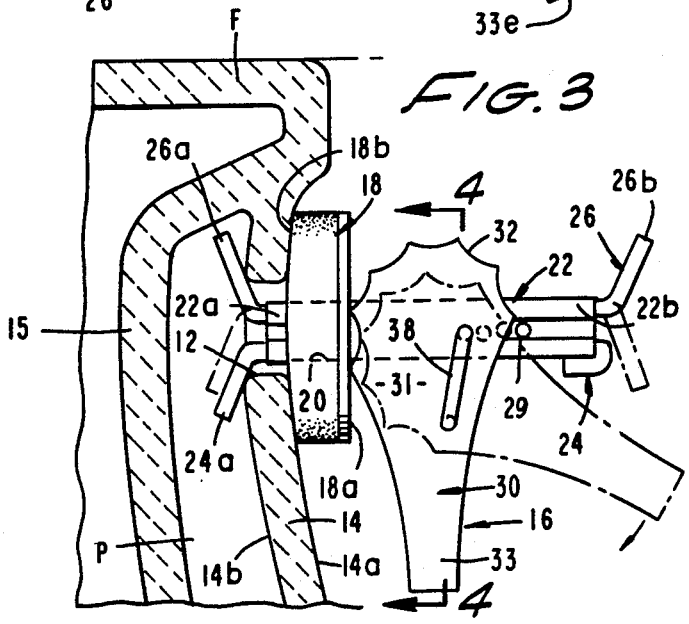
FIG. 3 is a side elevational view similar to FIG. 2, but illustrating the appearance of the device in a locked sealing position within the overflow drain.

Referring to FIG. 3, it can be seen that first locking element 24 includes an outwardly and downwardly extending leg portion 24*a* which protrudes from the first end 22*a* of member 22. When the apparatus of the invention is in position within the overflow or vent aperture 12 of the fixture as shown in FIG. 3, leg 24*a* is in engagement with the inner surface 14*b* of the wall 14. Locking element 26 also has an outwardly extending leg 26*a* provided proximate the forward end 22*a* of member 22 and an outwardly extending leg 26*b* provided proximate end 22*b* of member 22. Locking element 22 is rotatably carried within a tubular portion, or channel, C (FIG. 2) provided along margin 22*d* of support member 22. Locking element 26 is rotatable within tubular portion C from a first position as shown in FIGS. 1 and 2, wherein leg 26*a* extends downwardly, to a second position as shown in FIGS. 3 and 5, wherein leg 26*a* extends angularly upwardly. When element 26 is in the first position the locking elements along with the first end of the cam support member 22 can be inserted through the aperture 20 formed in sealing member 18 and also through the aperture 12 formed in the fixture F. This initial insertion step is illustrated in FIG. 2. Once the inboard end of the apparatus is in the position shown in FIG. 2, leg 26*b* is used to rotate locking element 26 to its second position as shown in FIGS. 3 and 5 wherein leg 26*a* moves into locking engagement with the inner surface 14*b* of wall 14. As previously mentioned the device of the invention is frequently used with dual wall fixtures having an overflow, or vent, passageway P defined between the inner wall 14 and an outer wall 15 of the fixture (FIGS. 2 and 3).

Once the locking leg 26*a* of the actuating means is rotated into the wall engaging position shown in FIGS. 3 and 5, the cam means of the invention is operated to urge face 18*b* of sealing member 18 into pressural engagement with surface 14*a* of wall 14. In the form of the invention shown in the drawings, the cam means comprises a generally "U" shaped cam member 30 having spaced apart first and second generally planar portions 30*a* and 30*b*, each of which has a central portion 31, in a cam surface 32 and a handle portion 33. Cam surfaces 32 are adapted to engage rigid surface 18*a* of sealing member 18 when the cam member is rotated relative to cam support member 22. The faces 30*a* and 30*b* of the cam member are interconnected by a bight portion 30*e* and each is provided with coaxially aligned apertures 34 (FIG. 1). Planar portion 30*a* is also provided with another aperture 36, the purpose of which will presently be described.

Figure 4:
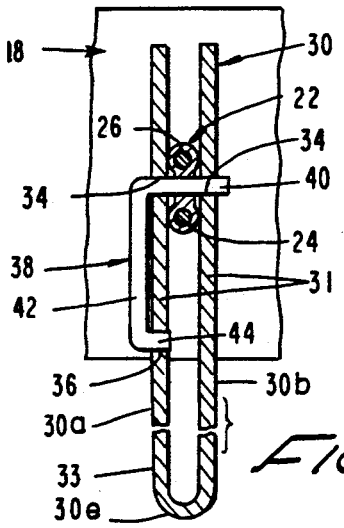
FIG. 4 is a cross sectional view taken along lines 4—4 of FIG. 3.

Also forming a part of the cam means of the instant form of the invention is a "U" shaped pivot pin 38. As best seen by referring to FIG. 4, pivot pin 38 includes an axial portion 40, a body portion 42 and a locking end portion 44. Cam member 30 is operably interconnected with cam support member 22 by inserting axial portion 40 of pivot pin 38 through aperture 34 first portion 30*a* of member 30, then into a selected aperture 29 provided in the web portion of cam support member 22 and finally through aperture 34 provided in portion 30*b* of the cam support member. When axial portion 40 is fully inserted in the manner shown in FIG. 4, locking end 44 will extend into aperture 36 provided in portion 30*a* of the cam member 30 in a manner to lock the assemblage together. Where the thickness of wall 14 of the fixture is relatively thin, an aperture 29 located closer to end 22*a* of member 22 is selected. Conversely, where wall 14 of the fixture is relatively thick, an aperture 29 located closer to the second end 22*b* of member 22 is selected for insertion of axial portion 40 of pivot pin 38.

In operation of the device, handle portion 33 is used to effect rotation of the cam means relative to the cam support member 22. As cam member 30 is rotated from the position shown in FIGS. 1 and 2 to the position shown in the phantom lines in FIG. 3, the cam surfaces 32 of the cam member will engage the rigid surface 18*a* of sealing member 18 and urge it into sealing engagement with face 14*a* of wall 14. Continued rotational movement of the cam member to the position shown by the solid lines in FIG. 3 will cause the resiliently deformable surface portion 18*b* of member 18 to deform and securely sealably engage the surfaces of face 14*a* of wall 14 which circumscribe aperture 12. With the apparatus in this locked position, aperture 12 is securely sealed against fluid flow in a direction through passageway P toward aperture 12. With aperture 12 being thusly sealed, fluid pressure exerted by the cleanout tool being used will be effectively directed against the blockage in the line so that the blockage can expeditiously be broken to allow normal flow of liquids through the drain lines.

When the blockage in the drain line has been cleared the cam member 30 can easily be rotated from the position shown in FIG. 3 to the position shown in FIG. 2. Locking element 26 is then rotated so that end 26*a* extends downwardly in the manner shown in FIG. 2. With the apparatus in this configuration, the first end of the cam supporting mechanism can easily be removed from aperture 12 provided in wall 14. When using the apparatus, if a desired seal is not obtained between sealing member 18 and wall 14, pivot pin 38 can be removed from the selected aperture 29 and replaced within an aperture located nearer end 22*a* of the cam support member.

Support member 22 as well as cam member 30 can be constructed from any rigid, durable material such as metal or plastic. Locking members 24 and 26 are preferably constructed from metal rod. Various materials such as rubber and other elastomerics can be used to form portion 18*b* of sealing member 18.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An apparatus for sealably closing an aperture provided in a wall having spaced apart first and second surfaces, comprising:

(a) wall engaging means for sealably engaging the first surface of the wall at a location surrounding the aperture, said wall engaging means comprising a sealing member having an aperture therethrough and including a first rigid surface and a second yieldably deformable surface for engagement with said first surface of said wall;

(b) actuating means operably associated with said wall engaging means for moving said sealing member into sealable engagement with the first surface of the wall, said actuating means comprising:

(i) a cam support member having first and second ends and an elongated web-like intermediate portion;

(ii) a first locking element connected to said cam support member and extending outwardly from the first end thereof for insertion into the aperture provided in the wall;

(iii) an outwardly extending second locking element rotatably connected to said cam support member for insertion into the aperture provided in the wall and for movement from a first position to a second position for engagement with the second surface of the wall;

(iv) cam means rotatably connected to said cam support member for engagement with said rigid surface of said sealing member to urge said sealing member into pressural engagement with the first surface of the wall when said second locking element is in said second position.

2. An apparatus for sealably closing an aperture provided in a wall having spaced apart first and second surfaces, comprising:

(a) wall engaging means for sealably engaging the first surface of the wall at a location surrounding the aperture, said wall engaging means comprising a sealing member having an aperture therethrough and including a first rigid surface and a second yieldably deformable surface for engagement with said first surface of said wall;

(b) actuating means operably associated with said wall engaging means for moving said sealing member into sealable engagement with the first surface of the wall, said actuating means comprising:

(i) a cam support member having first and second ends and including first and second margin portions and a web portion disposed intermediate said margin portions, said web portion having at least one aperture therethrough.

(ii) a first locking element connected to said cam support member and extending outwardly from the first end thereof for insertion into the aperture provided in the wall;

(iii) an outwardly extending second locking element rotatably connected to said cam support member for insertion into the aperture provided in the wall and for movement from a first position to a second position for engagement with the second surface of the wall;

(iv) cam means rotatably connected to said cam support member for engagement with said rigid surface of said member to urge said sealing member into pressural engagement with the first surface of the wall when siad second locking element is in said second position.

3. An apparatus as defined in claim 2 in which said first locking element comprises an elongated element having a body portion connected to said first margin portion of said cam support member and an end portion extending angularly from said first margin portion.

4. An apparatus as defined in claim 3 in which said second locking element comprises an elongated element having a body portion rotatably connected to said second margin portion of said cam support member and a first end portion extending angularly outwardly from said second margin portion.

5. An apparatus as defined in claim 4 in which said cam means comprises a cam member having a cam surface and a gripping means for imparting rotational movement to said cam member relative to said cam support member.

6. An apparatus as defined in claim 5 in which said cam member includes a first generally planar body portion having a central aperture therethrough and in which said cam means further comprises a pivot pin receivable within said central aperture and within said aperture in said web member of said cam support member, whereby said cam member is rotatable about said pivot pin to bring said cam surface into engagement with said first rigid surface of said sealing member to urge said second surface thereof into pressural engagement with siad first surface of said wall.

7. An apparatus as defined in claim 6 in which said cam member includes a second generally planar body portion spaced apart from said first body portion, said second body portion having a central aperture adapted to receive said pivot pin, said cam support member being receivable between said first and second generally planar body portions.

8. An apparatus as defined in claim 7 in which said web portion of said cam support member is provided with a plurality of spaced apart apertures for receiving said pivot pin.

9. An apparatus for sealably closing an overflow drain provided in the wall of a fixture, said wall having front and rear surfaces, said apparatus comprising:

(a) a generally planar wall engaging member having a rigid face and a yieldably deformable elastomeric face, said member having an aperture therethrough;

(b) an actuating assembly operably associated with said wall engaging member, said assembly including:

(i) an elongated cam support member having first and second ends, said first end being receivable within the aperture in said planar member, said cam support member further including first and second tubular portions and a web portion disposed intermediate said tubular portions, said web portion having at least one aperture therethrough;

(ii) a first locking element mounted within said first tubular portion of said cam support member and extending outwardly from said first end of said member;

(iii) an outwardly extending second locking element rotationally mounted within said second tubular portion of said cam support member for movement from a first position to a second position for engagement with the second surface of the wall;

(iv) cam means rotatably connected to said cam support member for engagement with said rigid face of said wall engaging member to urge said elastomeric face of said member into pressural engagement with the first surface of the wall when said second locking element is in said second position, said cam means comprising a cam member having a cam surface and a gripping means for imparting rotational movement to said cam member relative to said cam support member.

10. An apparatus as defined in claim 9 in which said cam member includes first and second spaced apart planar body portions each having a central aperture, said cam support member being receivable between said first and second planar body portions.

* * * * *